US009162266B2

(12) United States Patent
Keller et al.

(10) Patent No.: US 9,162,266 B2
(45) Date of Patent: Oct. 20, 2015

(54) INSTALLATION PART AND METHOD FOR THE PRODUCTION THEREOF

(71) Applicant: SMS Siemag AG, Duesseldorf (DE)

(72) Inventors: Karl Keller, Hilchenbach (DE); Daniel Knie, Freudenberg (DE); Konrad Roeingh, Hilchenbach (DE); Ralf Seidel, Dillenburg (DE)

(73) Assignee: SMS GROUP GMBH, Duesseldorf (DE)

( * ) Notice: Subject to any disclaimer, the term of this patent is extended or adjusted under 35 U.S.C. 154(b) by 0 days.

(21) Appl. No.: 14/361,714

(22) PCT Filed: Nov. 28, 2012

(86) PCT No.: PCT/EP2012/073786
§ 371 (c)(1),
(2) Date: Jan. 15, 2015

(87) PCT Pub. No.: WO2013/079503
PCT Pub. Date: Jun. 6, 2013

(65) Prior Publication Data

US 2015/0114066 A1 Apr. 30, 2015

(30) Foreign Application Priority Data

Dec. 1, 2011 (DE) ..... 10 2011 087 605

(51) Int. Cl.
*B21B 31/08* (2006.01)
*B21B 31/07* (2006.01)
*B21B 27/06* (2006.01)

(52) U.S. Cl.
CPC ..... *B21B 31/08* (2013.01); *B21B 27/06* (2013.01); *B21B 31/074* (2013.01)

(58) Field of Classification Search
CPC ..... B21B 31/08; B21B 31/074; B21B 27/06
USPC ..... 72/236
See application file for complete search history.

(56) References Cited

U.S. PATENT DOCUMENTS

| | | | | |
|---|---|---|---|---|
| 4,944,609 | A * | 7/1990 | Salter et al. | 384/118 |
| 6,783,131 | B2 | 8/2004 | Martins | |
| 7,789,568 | B2 | 9/2010 | Keller | |
| 7,836,742 | B2 | 11/2010 | Roeingh | |
| 8,371,148 | B2 * | 2/2013 | Keller et al. | 72/236 |
| 2002/0084594 | A1 | 7/2002 | Drigani | |
| 2009/0158801 | A1 | 6/2009 | Keller | |

FOREIGN PATENT DOCUMENTS

| | | | |
|---|---|---|---|
| DE | 10 2006 016 714 | A1 | 10/2007 |
| EP | 0 285 333 | A2 | 10/1988 |

* cited by examiner

*Primary Examiner* — David B Jones
(74) *Attorney, Agent, or Firm* — Abelman, Frayne & Schwab

(57) ABSTRACT

The invention relates to an installation part for mounting an upper support roll in a roll stand. The installation part has, on its cambered side, a lubricant receiving space, from which at least one lubricant drain hole (130) extends, in the lower region of the installation part, in the direction of the drain side of the installation part. In order to be able to reduce the width in the lower region of the installation part and while guaranteeing the stability of the installation part, it is proposed according to the invention that the distance d from the center point of the lubricant drain hole (130) to the vertical longitudinal center plane LM of the installation part is ≤half of the diameter of the main hole and that—in the vertical longitudinal center plane—the vertical minimum distance s from the counter-surface of a ring seal (400) in the lower region of the installation part to the horizontal tangential plane (500) at the top edge of the lubricant drain hole is not below a specified minimum clearance threshold value.

4 Claims, 6 Drawing Sheets

INSTALLATION PART AND METHOD FOR THE PRODUCTION THEREOF

RELATED APPLICATIONS

This is a National Stage application based on International application PCT/EP2012/073786 filed Nov. 28, 2012, designating the U.S. and claiming priority of German application DE 10 2011 087 605.7 filed Dec. 1, 2011, both applications being incorporated herein by reference thereto.

The invention relates to an installation part, i.e., a support housing for supporting an upper back-up roll in a rolling mill stand, typically, for hot rolling or cold rolling of a metal strip. In addition, the invention relates to a method of production of this installation part.

Basically, installation parts for supporting back-up rolls in rolling mill stands are well known in the state-of-the art.

E.g., the publication "Technical report on high-tech modules for rolling mills," Morgoil Roll-Neck Bearings" by K. Roeingh, 2002, page 4, Figs. I., II., III and FIGS. 1 and 2 discloses a historical review of development of constructions of such installation parts over time.

An installation part for supporting an upper back-up roll in a rolling mill stand is disclosed in an International Application WO 2007/115971. There is disclosed, in the installation part disclosed there, a main bore extending from the drain side to the cambered side of the installation part for receiving a roll journal of the upper back-up roll. The installation part further includes a lubricant receiving space provided on the cambered side in the lower region of the installation part, wherein the lubricant receiving space is associated with two lubricant drain holes arranged mirror-symmetrically with regard to a longitudinal middle plane and which extend from the lubricant receiving space on the cambered side in direction of the drain side of the installation part.

The centers of the lubricant drain holes are spaced from each other by a distance greater than the diameter of the main bore.

Proceeding from this state-of-the art, the object of the invention is to further modify the known installation part and the known method so that in the cross-section of the installation part transverse to the longitudinal direction of the supported roll, recesses can be provided in the right and left lower corners of the installation part.

This object is achieved by the subject matter of claim 1. According to the claim, the installation is characterized in that, viewing in direction of the cambered side, the lubricant drain hole is so arranged that a distance of a center point of the lubricant drain hole to a transverse longitudinal middle plane of the installation part is smaller than/equal to half of the diameter of the main bore and that in the transverse longitudinal middle plane a minimal distance(s) from a counter-surface of an annular seal in the lower region of the installation part to a horizontal tangential plane at top edge of the lubricant drain hole does not exceed a predetermined minimal distance threshold.

The counter-surface of the annular seal corresponds, in the mounted condition of the installation part and the roll, to the outer diameter of the pilot bush extension on which the annular seal is supported.

By taking into account these two claimed criteria it became possible to succeed in greatly reducing the width of the installation part in the lower region at least on the cambered side so that in the right and left corner regions of the installation part, recesses could be provided, e.g., for receiving negatively operating bending cylinders. While the first claimed criterion essentially defines the remaining width of the upper installation part in the lower region, the second criterion insures that the cambered side sealing remains completely functioning. I.e., the produced oil sump is not raised to the extent that the pilot bush extension rotates in this oil sump, which results in leakage.

In the following description, terms "lower," "upper," "transverse," and "horizontal" are used. These terms are used to describe the position of separate technical elements of the installation part or to describe a relative position of separate technical elements relative to each other. When using these terms, one proceeds from a premise that the installation part lies in a horizontal plane. In FIGS. 1 through 6, one can proceed from the fact that the installation part is arranged in a horizontal plane and as, e.g., shown in FIG. 1, is supported horizontally in the stand window.

According to a first embodiment, the installation part has on its cambered side, a seal retaining element for retaining the annular seal according to the invention, the seal retaining element is formed as one piece with the installation part. In constructions according to the state-of-the art, this seal retaining element is often placed on the installation part as a lid. It is expensive from the manufacturing point of view as the lid must be produced as a separate component. In addition, the mounting and dismounting of the lid is time-consuming and, therefore, is likewise costly. By formation of the seal retaining element together with the installation part as a one-piece cast part, advantageously, separate production of the lid and the time-consuming and costs-extensive mounting and dismounting of the lid are dispensed with.

The annular seal serves for sealing of the installation part with respect to the roll neck or the pilot bush extension. The annular seal also serves for sealing the lubricant receiving space against the body of the upper back-up roll.

According to a further advantageous embodiment, the installation part has two lubricant drain holes which are arranged mirror-symmetrically relative to the transverse longitudinal middle plane in the lower region of the installation part. The provision of two lubricant drain holes insures draining of the lubricant. The formation of the lubricant receiving space according to a further embodiment of the invention, as a circular groove on the cambered side and which has a widening in the lower region of the installation part, has an advantage consisting in that lubricant that exits from a clearance between the bearing bush and the pilot bush can be picked up circumferentially. The advantage of the widening consists in that sufficient space for collected lubricant is available, in particular in the lower region of the installation part where the exiting, under the gravity force, lubricant is collected.

The widening, in the lower region of the installation part on its cambered side, can be formed, from the constructional point of view, without any problem, because there in the lower region no particular large rolling forces are generated. The rolling force acts, with an upper back-up roll and an installation part that receives it, upwardly, i.e., in the upper region of the installation part, as it is known from the state-of-the art.

Typically, the installation part includes a cylindrical bearing received in its main bore.

According to a further embodiment of the invention, a wall of the installation part remote from the cambered side and limiting the lubricant receiving space extends radially smoothly when viewed from a longitudinal axis of the installation part outwardly. It is important that the inner side of the installation part is force and formlockingly connected with the bearing bush over its entire width to a most possible extent. Advantageously, the wall according to the invention, because of its radial smoothness has no projections or noses extending toward the side of the roll body and force-and form-lockingly engageable with the bearing bush. The construction according to the invention insures an optimal force transmission from the neck of the back-up roll over the pilot bush and the bearing bush toward the installation part, this being the case with known projections and noses.

The annular lubricant receiving space and its widening are formed, according to the invention, by being milled in the previously produced cast installation element. The lubricant drain holes can be simply produced by drilling in the cast installation part. Milling and drilling enable geometrically very precise formation of the lubricant receiving space, its widening, and the drain bores The description is accompanied by six figures, wherein.

The invention will be described in details below with reference to the above-listed figures which show embodiments of the invention. In all of the figures, the same technical elements are designated with the same reference numerals.

Figure 1:
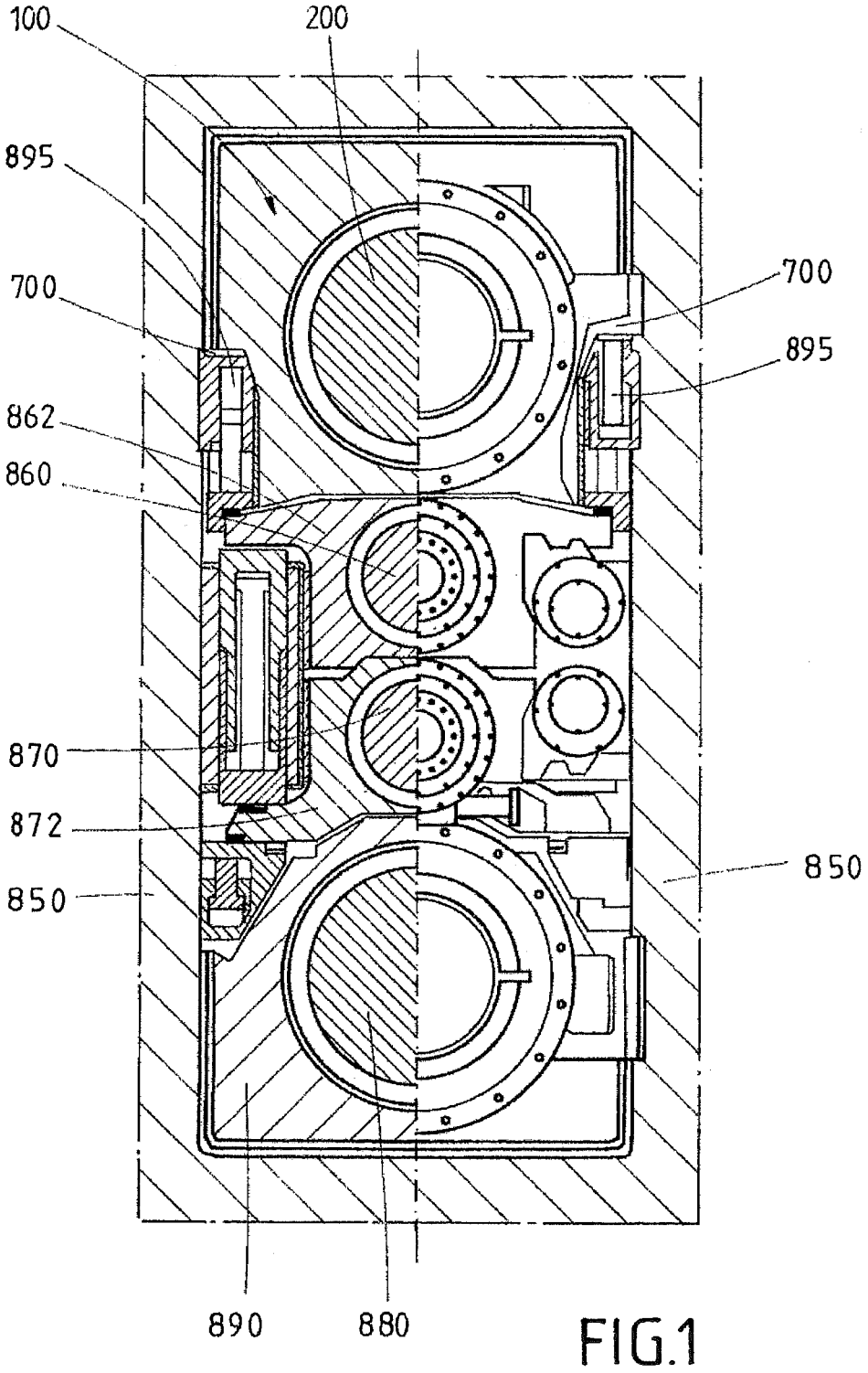
FIG. 1 shows a cross-sectional view of a stand window of a rolling mill stand.

FIG. 1 shows a cross-sectional view of a stand window of a rolling mill stand. The stand window bears a reference numeral 850 In the middle of the stand window, there are arranged an upper work roll 860 and a lower work roll 870 which are rotatably supported in work roll installation parts 862,872 and are supported for vertical displacement in the stand window 850. A lower back-up roll 880 is associated with the lower work roll 870 and is rotatably supported in a lower back-up roll installation part 890. An upper back-up roll 200 is associated with the lower work roll 860 and is rotatably supported in an upper back-up roll installation part 100 and, advantageously, is axially displaceable in the stand window 850. The embodiment of this upper back-up roll installation part 100 is the subject matter of the present invention.

FIG. 1 shows that in the shown cross-section of the stand window, the upper back-up roll installation part has, in its left and right corners, recesses 700, respectively, for providing space, e.g., for arrangement of negatively operating bending cylinders 895 which are usually fixedly mounted in the stand window.

Figure 2:
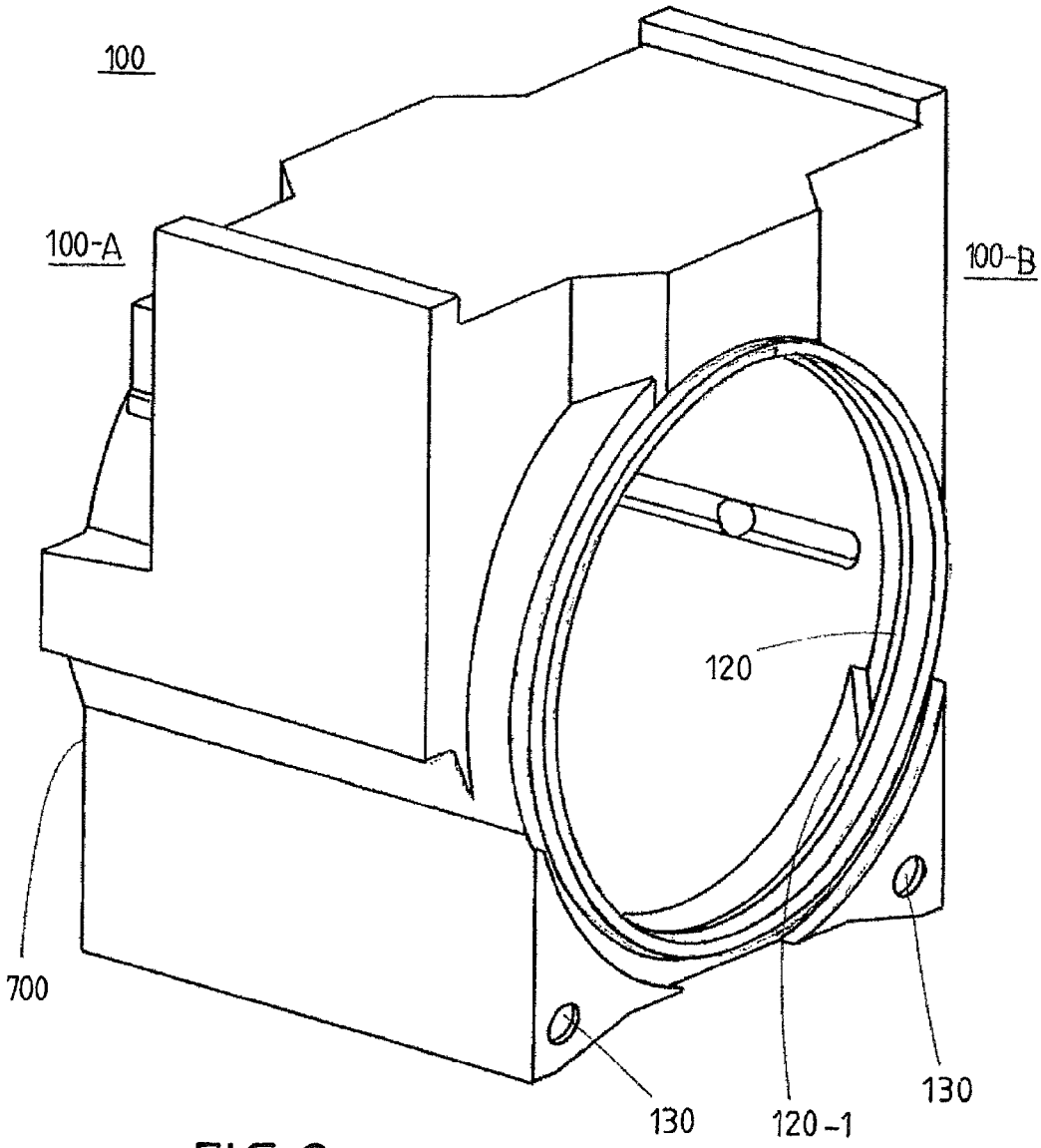
FIG. 2 shows a perspective view of the inventive installation part seen from its cambered side.

FIG. 2 shows a perspective view of the upper back-up roll installation part 100. In the foreground, the cambered side 100-B of the installation part is shown; this is the side which later, with the mounted back-up roll, is located adjacent to the body of the back-up roll. Opposite the cambered side, the drain side 100-A of the installation part is located, into which lubricant which is collected in the receiving space 120 and a widening 120-1 during a rolling operation, is drained through lubricant drain holes (130).

It can be seen that the inventive construction provides for recesses 700 the space of which, e.g., can be used for housing of the above-mentioned negatively operated bending cylinders 895.

Figure 3:
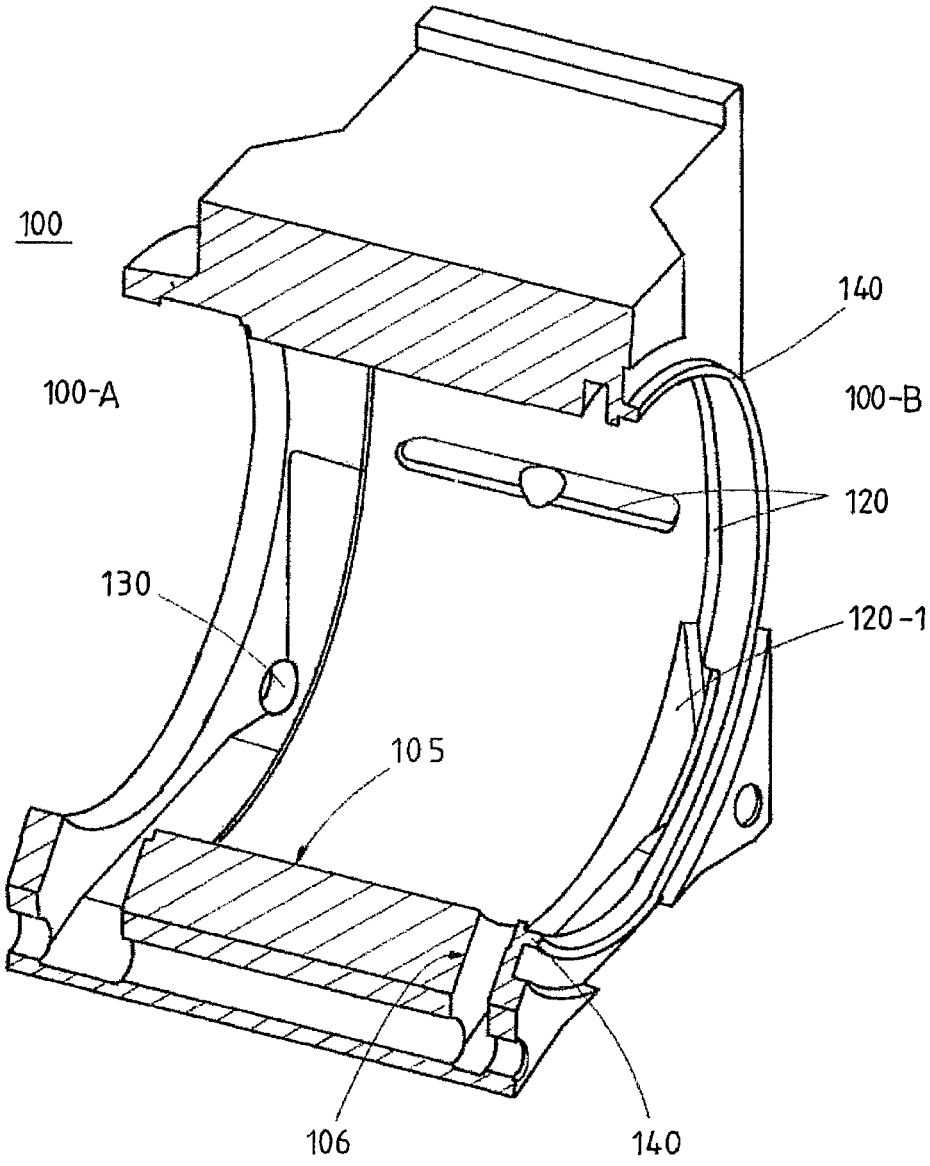
FIG. 3 shows a perspective view of the installation part according to FIG. 2 in a cut-off condition.

FIG. 3 shows the installation part shown in FIG. 2 in a cut-off condition. In addition to the above-mentioned ring-shaped and groove-shaped circular lubricant receiving space 120 and its widening 120-1, there is shown a seal holding ring 140 which is formed, according to the invention, as one piece with the installation part. Preferably, it is cast simultaneously with the cast installation part. The seal holding ring 140 serves for receiving the annular seal 400 as will be explained further below in detail with reference to FIG. 6.

Figure 6:
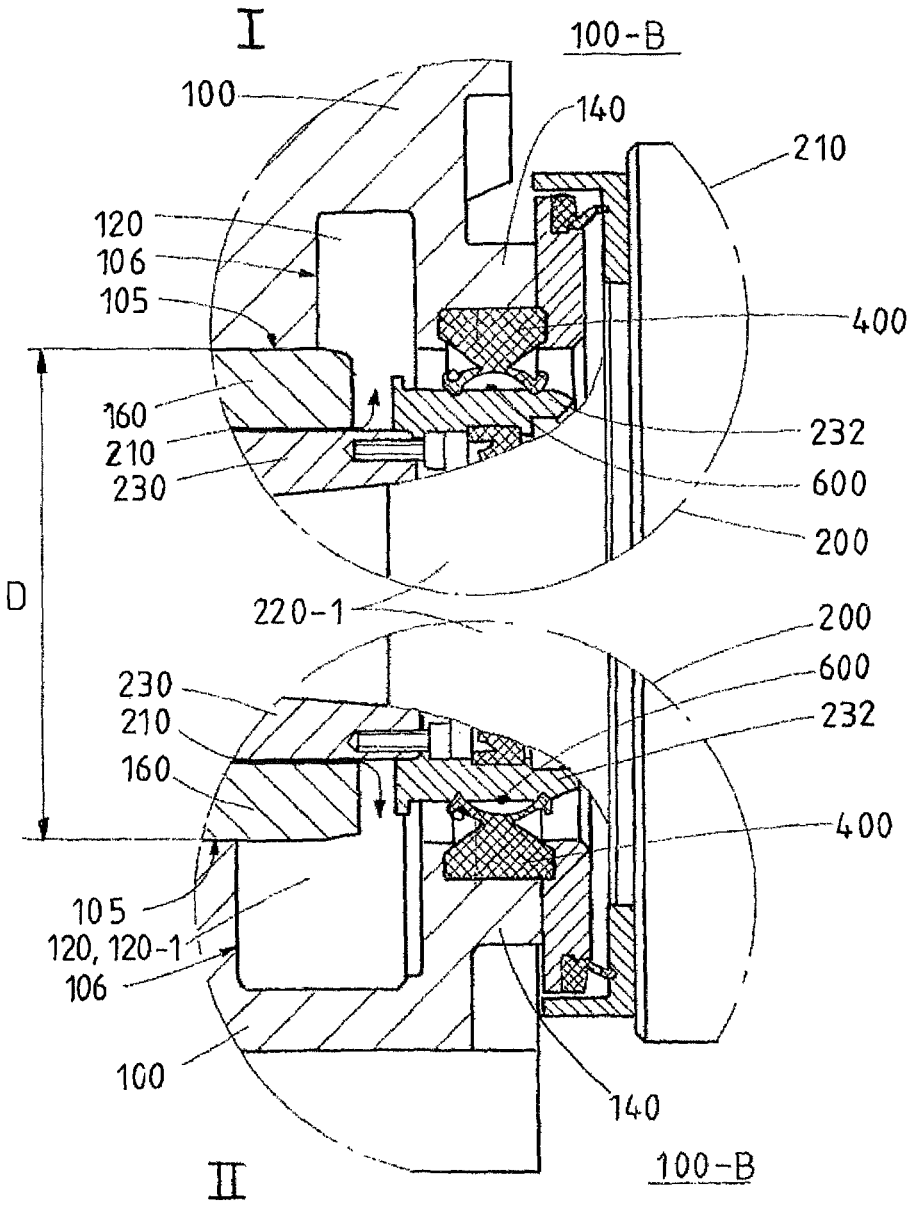
FIG. 6 shows a sealing of an upper back-up roll in the installation part with details of the upper region of the installation part and the lower region of the installation part at an increased scale.

As shown in FIG. 3, the installation part has an inner side 105 force- and form-lockingly engageable by a bearing bush 160, see FIG. 6. In addition, the side of the groove-shaped circular lubricant receiving space 120, which is located opposite the cambered side, is designated with the reference numeral 106. According to the invention, this wall is formed, with reference to the longitudinal axis L of the installation part, radially smoothly.

Figure 4:
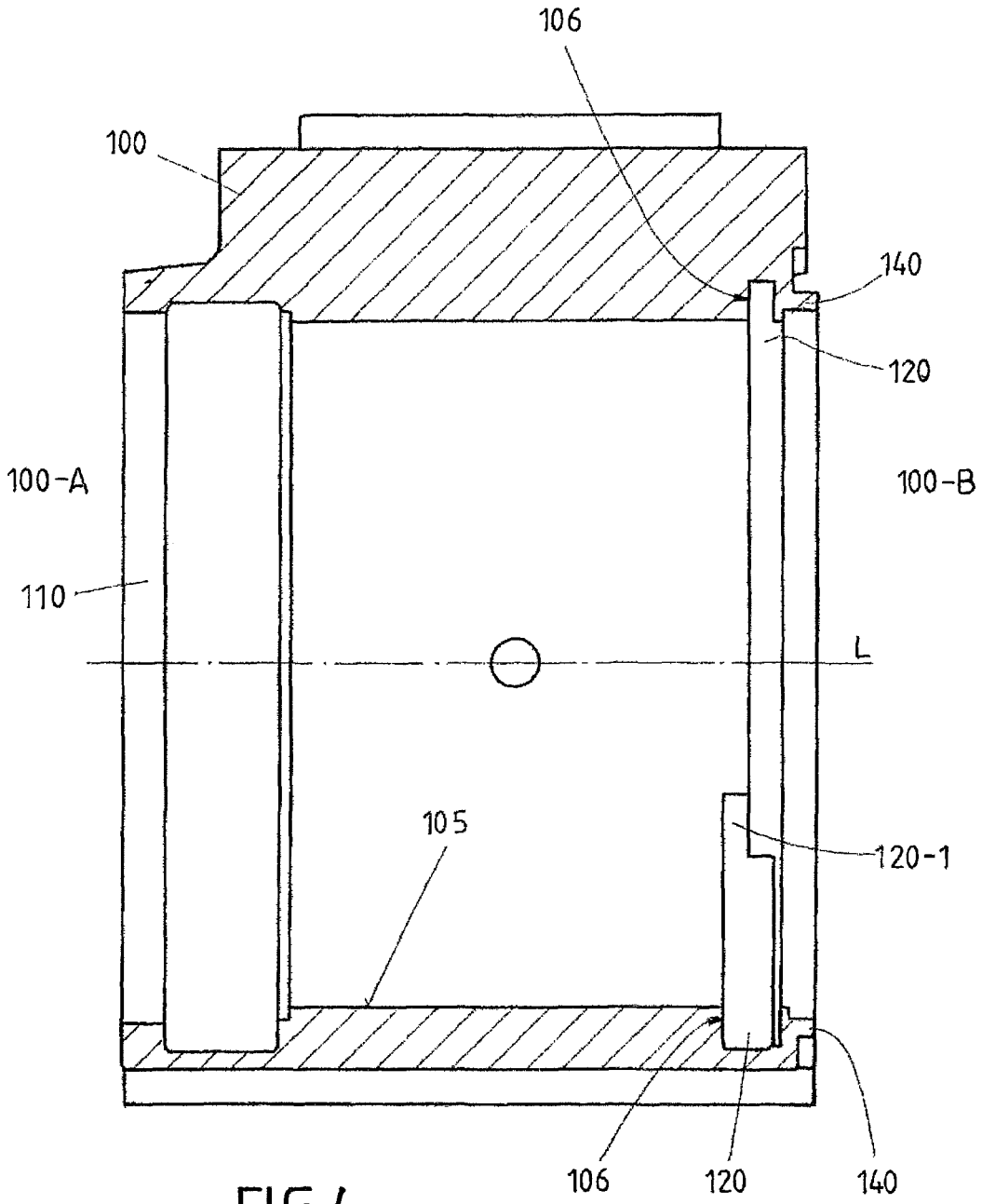
FIG. 4 shows a longitudinal cross-sectional view of the inventive installation part.

FIG. 4 shows a longitudinal cross-sectional view of the inventive installation part through the longitudinal axis L. Here, the diameter of the main bore 110 of the installation part is shown at an increased scale.

Figure 5:
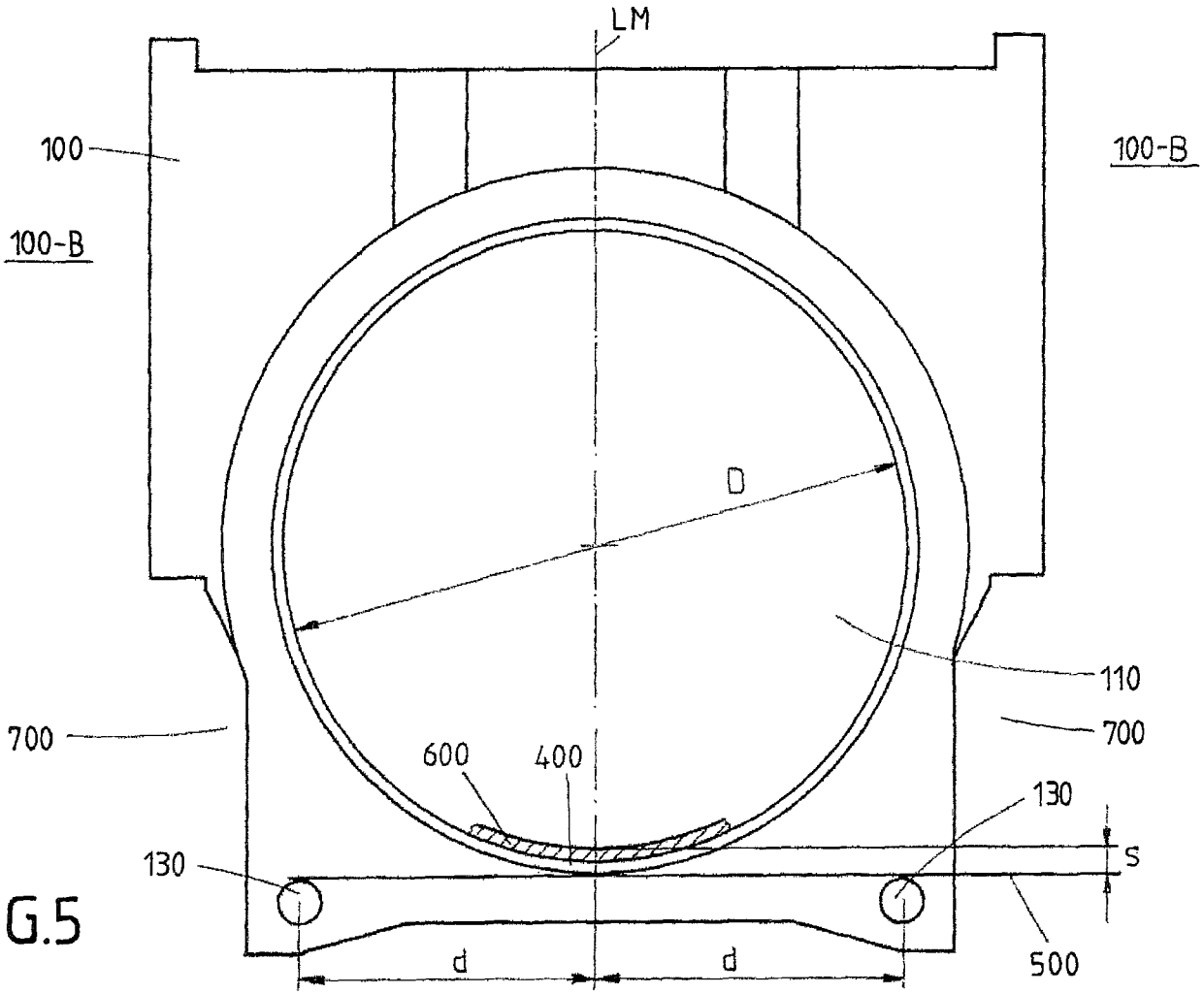
FIG. 5 shows a cross-sectional view of the inventive installation part through its cambered side.

FIG. 5 shows a cross-section of the installation part of the upper back-up roll on its use side.

In this view, in particular, the essential criteria for arranging and positioning of the lubricant drain bores 130 are shown. Firstly, a distance d that defines the spacing of the center of a lubricant drain hole 130 from the longitudinal, transversely extending, middle plane LM, is shown. According to the invention, the distance d should be ≤half of the diameter D of the main bore 110 of the installation part, without the bearing bush, in order to be able to so reduce the width of the installation part in the internal region that the desired recesses 700 can be provided. Simultaneously, in the transverse longitudinal middle plane LM, the transverse minimal distance s from the outer surface of the pilot bush extension 232, see FIG. 6, i.e., the running diameter or the counter-running surface 600 of the annular seal 400 in the lower region of the installation part, to the horizontal tangential plane 500 at the top edge of the lubricant drain hole 130 should not exceed a predetermined minimal threshold distance. This is necessary to insure the function of the annular seal. The minimal threshold distance for the distance s amounts, e.g., to 2 mm; the upper limit for this distance can be set, e.g., at 10 mm.

FIG. 6 shows the inventive installation 100 with a mounted upper back-up roll 200. The upper partial view in FIG. 6 shows the upper region I of the installation part with the annular seal 400, and the lower detail view II in FIG. 6 shows the inner portion of the installation part with the same annular seal 400. Both views show the same installation part 100.

The upper back-up roll 200 has a roll body 210 and a roll neck 220-1. A pilot bush 230 is secured on the roll journal for joint rotation therewith and has a screwed-on pilot bush extension 232 extending in the direction of the roll body. The back-up roll 200, together with the roll neck 220-1 and the pilot bush 230, is rotatably supported in the bearing bush 160. Between the bearing bush 160 and the pilot bush 230, a lubricant film 205 is formed. During rolling operation, lubricant medium is drained from the film into the lubricant receiving space 120 and its widening 120-1. The bearing bush 160 is secured in the main bore 110 of the installation part 100 without possibility of rotation.

Further, in FIG. 6, a seal retaining ring 140 which is formed as one piece with the installation part, can be seen. The seal retaining ring 140 serves for receiving the annular seal 400 the sealing lips of which engage the pilot bush extension 232 and here, a sealing function is carried in both direction (to prevent appearance of the lubrication oil at the outlet in the direction of the roll body and penetration of the cooling water, with occasional dirt, in the lubrication oil space, i.e., in the lubricant receiving space).

LIST OF REFERENCE NUMERALS

100 Installation Part
100-A Drain side of the installation part
100-B Cambered side of the installation part
105 Inner side of the installation part
106 Wall
110 Main bore
120 Lubricant receiving space
120-1 Widening of the lubricant receiving space
130 Lubricant drain hole
140 Seal retaining ring
160 Bearing bush
200 Upper back-up roll
'205 Lubricant film
210 Roll body
220-1 Roll neck of the upper back-up roll
230 Pilot bush
232 Pilot bush extension
400 Annular seal
500 Horizontal tangential plane
600 Counter-surface of sealing lips of the annular seal
700 Recesses
850 Stand Window
860 Upper work roll
870 Lower work roll
872 Installation part for the lower work roll
880 Lower back-up roll
895 Bending cylinder
D Diameter of the main bore
d Distance
s Distance
LM Transverse longitudinal middle plain of the installation part
L longitudinal axis

The invention claimed is:

1. An installation part for supporting an upper back-up roll (200) having a roll body (210) and two roll necks (220-1), in a rolling mill stand, comprising:

opposite drain side (100-A) and cambered side (100-B);

a main bore (110) for receiving one of the roll necks and extending from the drain side (100-A) to the cambered side (100-B);

a lubricant receiving space (120) provided on the cambered side (100-B), formed as a circular groove that surrounds the main bore (110), and having, in a lower region of the installation part (100), a widening (120-1) extending in axial and circumferential directions;

an annular seal (400) located in the lower region of the installation part (100); and at least one lubricant drain hole (130) extending from the lubricant receiving space (120) on the cambered side in direction of the drain side (100-A) of the installation part (100), the lubricant drain hole (130) having a center point a distance (d) of which to a transverse longitudinal middle plane (LM) of the installation part (100), viewing in direction of the cambered side, is smaller than or equal to half of a diameter of the main bore (110), characterized in that the annular seal (400) has a counter-surface (600) a minimal distance (s) of which to a horizontal plane (500) extending tangentially at a top edge of the at least one lubricant hole, in the transverse longitudinal middle plane (LM) is greater than 2 mm and less than 10 mm, and that the installation part (100) has a wall (106) remote from the cambered side (100-B) and limiting the lubricant receiving space (120, 120-1), the wall (106), viewed from a longitudinal axis (L) of the installation part (100) outwardly, extending smoothly in a radial direction of the installation part (100).

2. An installation part according to claim 1, characterized in that the installation part (100) has, on the cambered side (100-B) thereof, a seal retaining element for retaining the annular seal (400) and which is formed as one piece with the installation part (100).

3. An installation part (100) according to claim 1, characterized in that the installation part (100) has a further lubricant drain hole (130), the at least one lubricant drain hole and the further lubricant drain hole being arranged mirror-symmetrically relative to the transverse longitudinal middle plane (LM) in the lower region of the installation part.

4. An installation part (100) according to claim 1, characterized in that the installation part (100) has an inner surface (105) having, at least in region of the lubricant receiving space (120, 120-1), a cylindrical profile for force-and form-lockingly receiving a cylindrical bearing bush received in the main bore (130).

* * * * *